US006370691B2

(12) United States Patent
Park

(10) Patent No.: US 6,370,691 B2
(45) Date of Patent: Apr. 16, 2002

(54) BASEBALL GLOVE

(76) Inventor: Robert Tae-Boo Park, Daelim Apt. 121-701, 317-40, Haengdang-Dong, Seongdong-Ku, Seoul (KR)

( * ) Notice: Subject to any disclaimer, the term of this patent is extended or adjusted under 35 U.S.C. 154(b) by 0 days.

(21) Appl. No.: 09/776,779

(22) Filed: Feb. 6, 2001

(30) Foreign Application Priority Data

Feb. 12, 2000 (KR) ..... 00-3714

(51) Int. Cl.[7] ..... A41D 13/08
(52) U.S. Cl. ..... 2/19
(58) Field of Search ..... 2/19, 16, 158, 2/159, 161.1, 161.3, 161.8, 169

(56) References Cited

U.S. PATENT DOCUMENTS 1,056,909 A * 3/1913 King ..... 2/19
4,149,296 A * 4/1979 Stanford ..... 2/161.8
4,339,830 A * 7/1982 Sasaki ..... 2/19
5,402,537 A * 4/1995 Kolada ..... 2/19
5,572,739 A * 11/1996 Kolada et al. ..... 2/19
6,092,238 A * 7/2000 Fierabend, Jr. ..... 2/161.8

* cited by examiner

*Primary Examiner*—John J. Calvert
*Assistant Examiner*—Gary L. Welch
(74) *Attorney, Agent, or Firm*—Bacon & Thomas, PLLC

(57) ABSTRACT

A baseball glove. The baseball glove includes a rough skin on the inner surfae of its thumb and finger sections. In the baseball glove, the rough skin is formed by regularly, repeatedly and shallowly cutting the inner surface of the thumb and finger sections to form several rows of arc-shaped and dense cuts, each including a groove and a ridge. The rows of cuts are oriented along a direction perpendicular to an axial direction of the thumb and finger sections. The grooves of the cuts are inclined toward the finger tips of the glove, thus allowing each ridge to have an arc shape curved towards the palm and to be raised up from the skin of the glove so as to brake the rotating action of the ball in addition to preventing an unexpected slipping of the ball out of the glove when catching the ball.

1 Claim, 7 Drawing Sheets

BASEBALL GLOVE

BACKGROUND OF THE INVENTION

1. Field of the Invention

The present invention relates to baseball gloves, including catcher's gloves, first baseman's gloves and fielder's glovers, and, more particularly, to a baseball glove having a rough skin on the inner surface of its thumb and finger sections, the rough skin being formed by regularly, repeatedly and shallowly cutting the inner surface of the thumb and finger sections of the glove to form several rows of arc-shaped and dense cuts consisting of grooves and ridges, and acting as a braking means capable of braking the rotating action of a ball in addition to preventing an unexpected slipping of the ball out of the glove and allowing a user in a game to stably catch the ball without failure.

2. Description of the Prior Art

As well known to those skilled in the art, conventional baseball gloves are typically made of leather, and are classified into three types: catcher's mitts or the gloves used by catchers, first baseman's mitts or the gloves used by first basemen, and fielder's gloves used by pitchers and fielders except for the catchers and first basemen. The catcher's mitts are rounded gloves with one internal section for the four fingers and another for the thumb and having the side next to the palm of the hand protected by a thick padding. The first baseman's mitts are somewhat similar gloves to those of the catcher's mitts but with less padding and having sections for the thumb and one or two fingers. On the other hand, the fielder's gloves have five separate sections for each of the thumb and four fingers.

FIGS. 1, 2 and 3 are perspective views, showing a conventional catcher's glove, a conventional first baseman's glove, and a conventional fielder's glove, respectively.

As shown in FIG. 1, the conventional catcher's glove 1 is used by a catcher in a game for catching a ball delivered by a pitcher, and so it is designed to protect the catcher's hand from impact of the pitched ball. The catcher's glove 1 is thus typically provided with one internal section for the four fingers and another for the thumb, and has the side next to the palm of the hand protected by a thick padding, thereby having a rounded shape when fully opened.

The conventional first baseman's glove 2 of FIG. 2 is used by a first baseman in a game for catching the feint ball delivered by a pitcher so as to out the runner and for catching the ball delivered by an infielder so as to out the batter in the case of a ground ball (the feint ball refers to a ball thrown by the pitcher to peg a runner on the base, or a ball thrown by the pitcher to prevent a runner from stealing the next base). Therefore, the first baseman's glove 2 is most frequently used for catching the balls in a game. It is thus necessary to design the first baseman's glove 2 such that the glove 2 is suitable for effectively catching the ball. Therefore, the first baseman's glove 2 has a somewhat similar shape to that of the catcher's glove 1 but with less padding and having sections for the thumb and one or two fingers. In addition, the size of the first baseman's glove 2 is somewhat larger than the other fielder's gloves.

On the other hand, the conventional fielder's glove 3 of FIG. 3 has five separate sections for each of the thumb and four fingers. In the conventional fielder's glove 3, the separate sections for the thumb and fingers are integrated into a single body by a web 4 and laces, thus allowing a fielder to catch the ball in a game.

In a baseball game, the infielders and outfielders often catch the flies, the liners and the grounders using their leather gloves. The term "fly" means a ball that is batted up into the air, and is also called "fly ball". The term "liner" means a batted ball that travels low, fast, and straight, and is also called "line drive". On the other hand, the term "grounder" means a batted ball that rolls or bounces along the ground, and is also called "ground ball".

Of the above-mentioned three types of batted balls, it is most difficult for the fielders in a game to catch the grounders.

Most fielders in a game catch a grounder while running toward the batted grounder from their original positions. However, the fielders may often miss the grounder due to the unexpected slipping of the ball from the thumb and finger sections 5 and 6 with the web 4 of the glove.

Such a missing of the grounder from the glove due to the slipping is typically caused by both the rotating force of the ball and the repulsive power created by impact of the collision between the skin of the glove and the ball at the time the grounder comes into contact with the skin with impact. Such conventional baseball gloves are only designed to catch the ball by closing the thumb and finger sections together around the web and palm, but are not provided with any separate means for braking the rotating action of the ball in the glove or preventing the missing of the ball due to the slipping.

SUMMARY OF THE INVENTION

Accordingly, the present invention has been made keeping in mind the above problems occurring in the prior art, and an object of the present invention is to provide a baseball glove, which has a rough skin on the inner surface of its thumb and finger sections, thus effectively braking the rotating action of a ball in the glove in addition to preventing an unexpected slipping of the ball out of the glove, and allowing a user in a game to stably catch the ball without failure.

In order to accomplish the above object, the present invention provides a baseball glove having a rough skin on the inner surface of its thumb and finger sections, the rough skin being formed by regularly, repeatedly and shallowly cutting the inner surface of the thumb and finger sections of the glove to form several rows of arc-shaped and dense cuts consisting of grooves and ridges and providing a rough surface.

In the baseball glove of this invention, the rough skin, formed on the inner surface of the thumb and finger sections of the glove and having the several rows of arc-shaped and dense cuts, acts as a stopper or a braking means capable of braking the rotating action of a ball in addition to reducing the repulsive power created by the force of the ball's impact acting on the skin when catching the ball in a game, thereby preventing an unexpected slipping of the ball out of the glove and allowing a user in the game to stably catch the ball without failure.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE INVENTION

Figure 1:
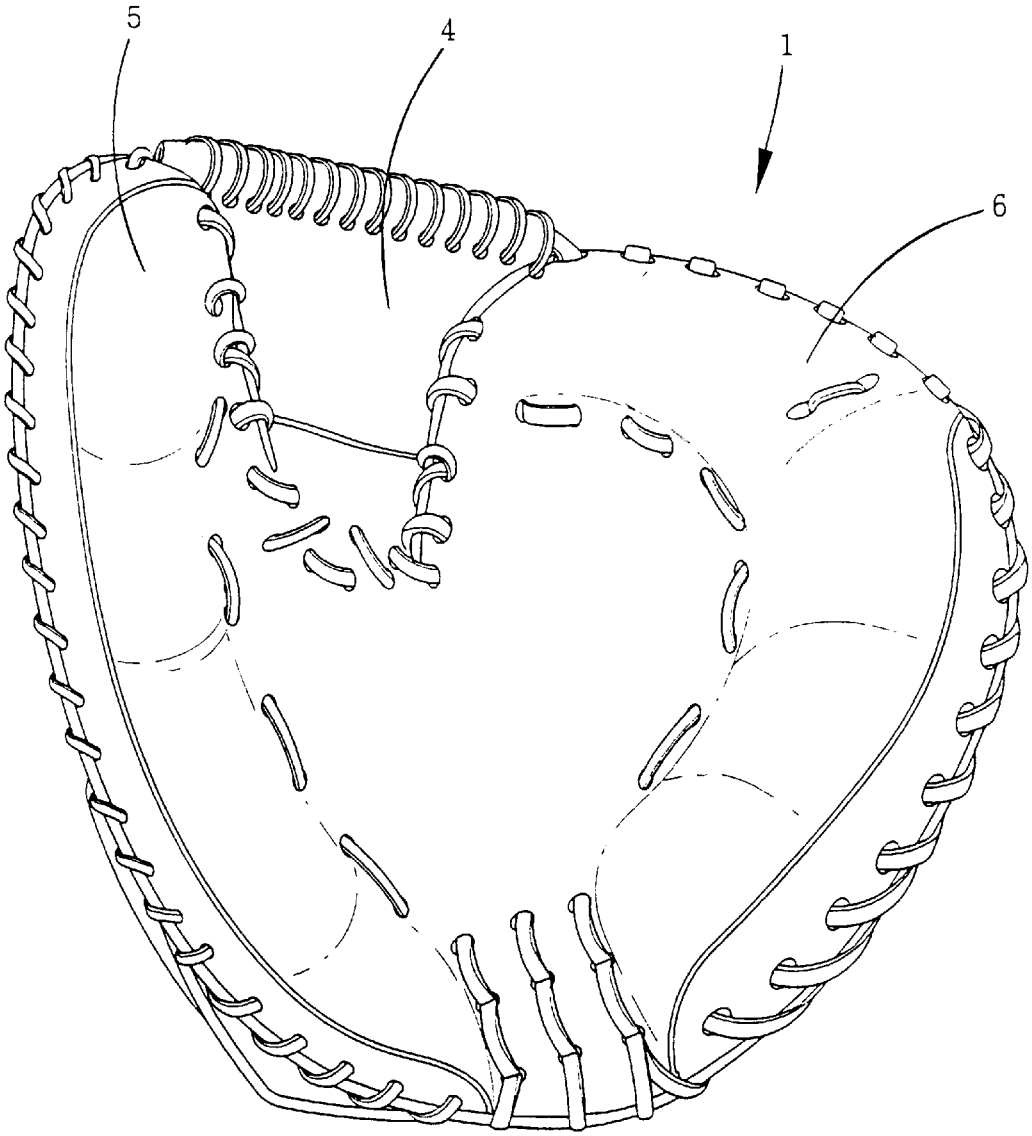
Fig. 1 PRIOR ART
FIG. 1 is a perspective view of a conventional catcher's glove.
Figure 2:
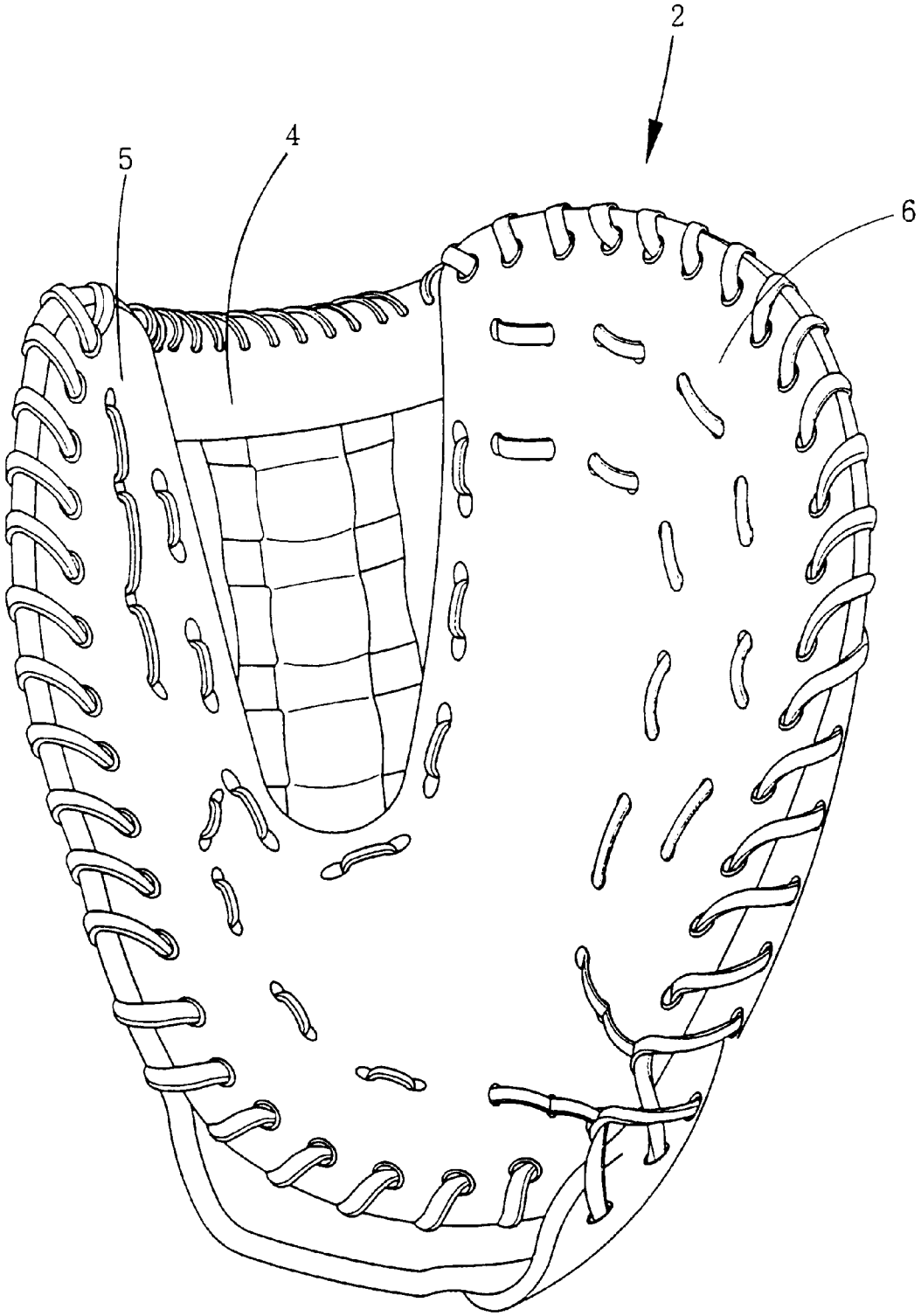
Fig. 2 PRIOR ART
FIG. 2 is a perspective view of a conventional first baseman's glove.
Figure 3:
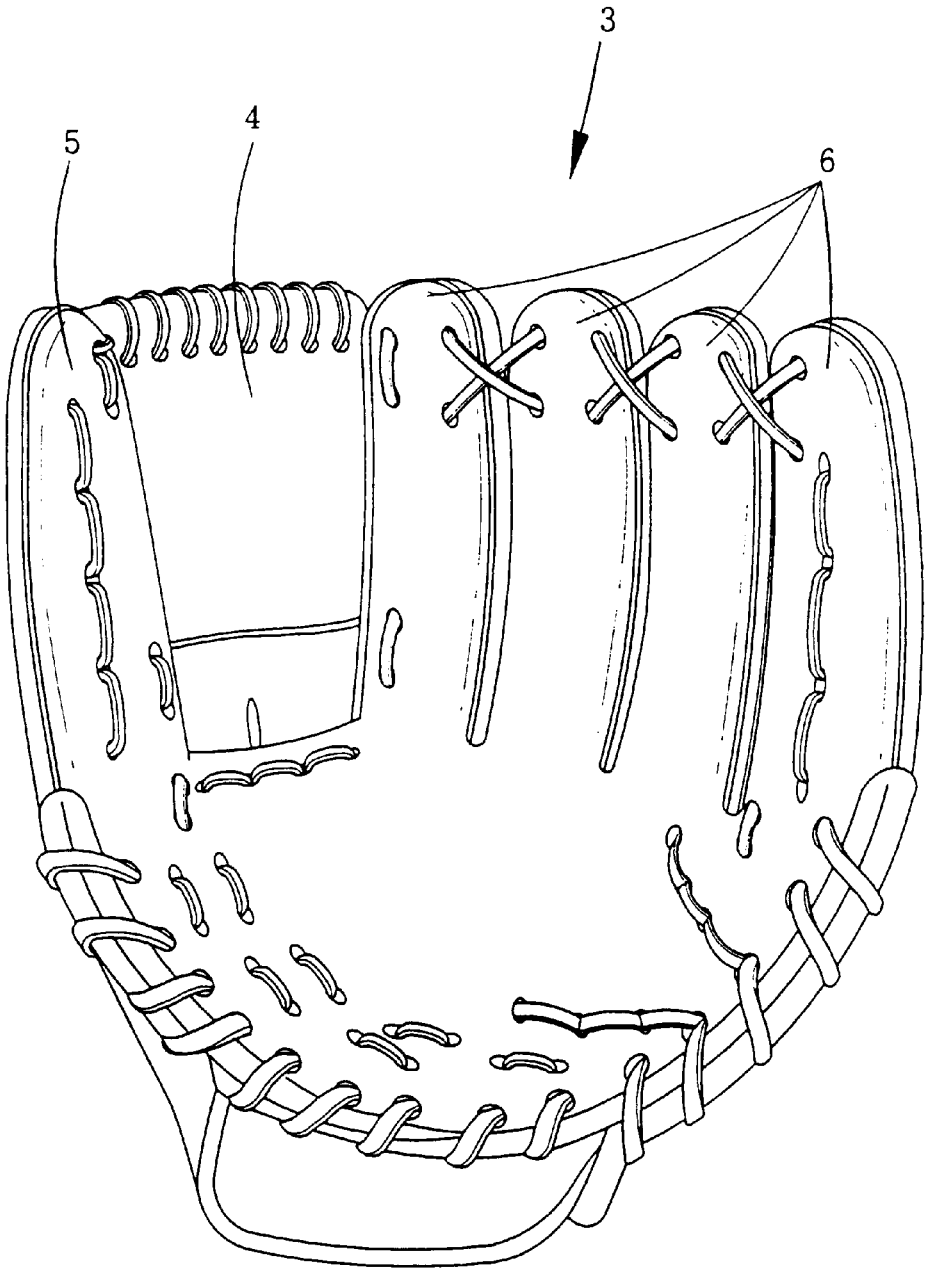
Fig. 3 PRIOR ART
FIG. 3 is a perspective view of a conventional fielder's glove.
Figure 4:
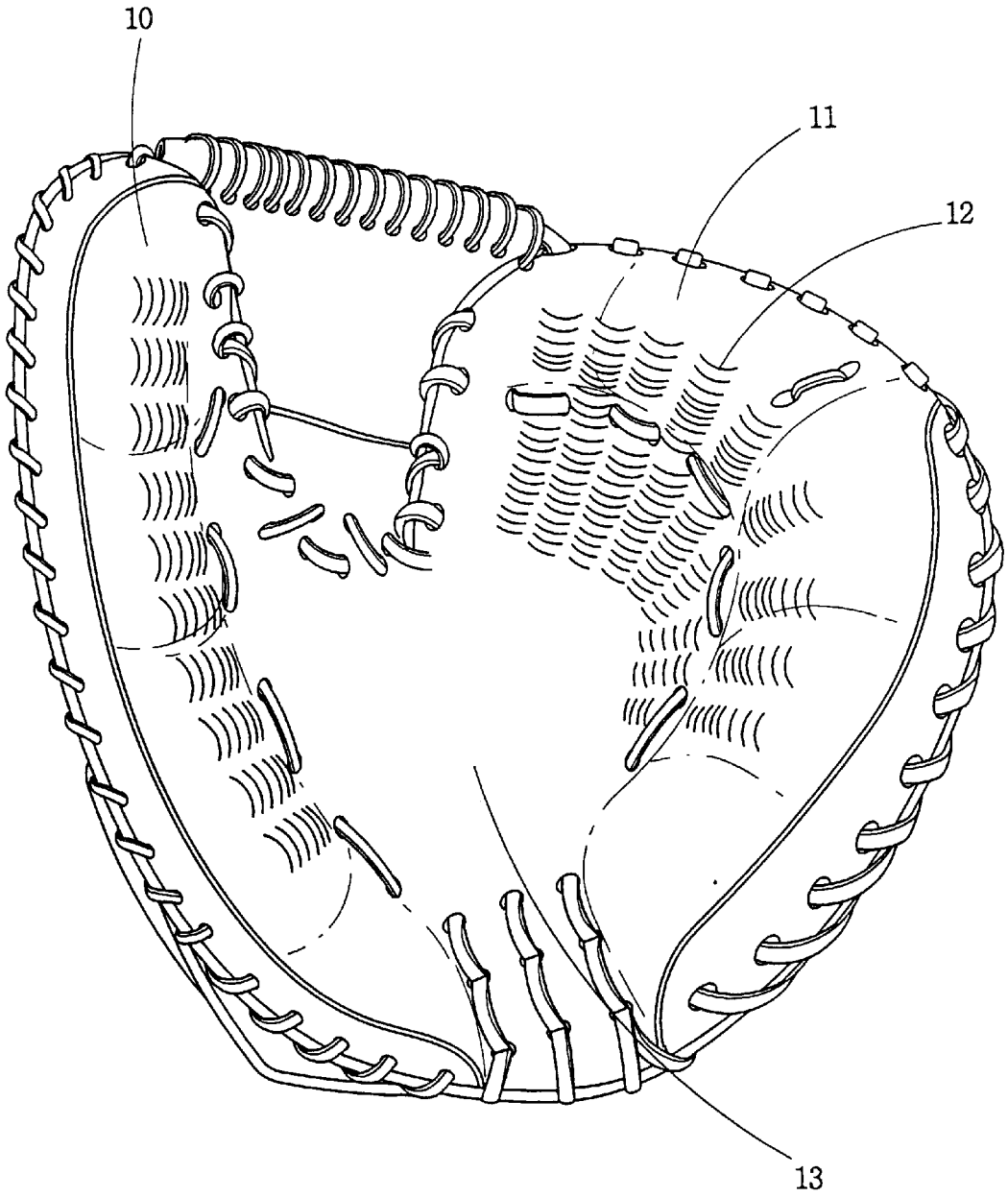
FIG. 4 is a perspective view of a catcher's glove having a rough skin at its thumb and finger sections in accordance with the primary embodiment of the present invention.
Figure 5:
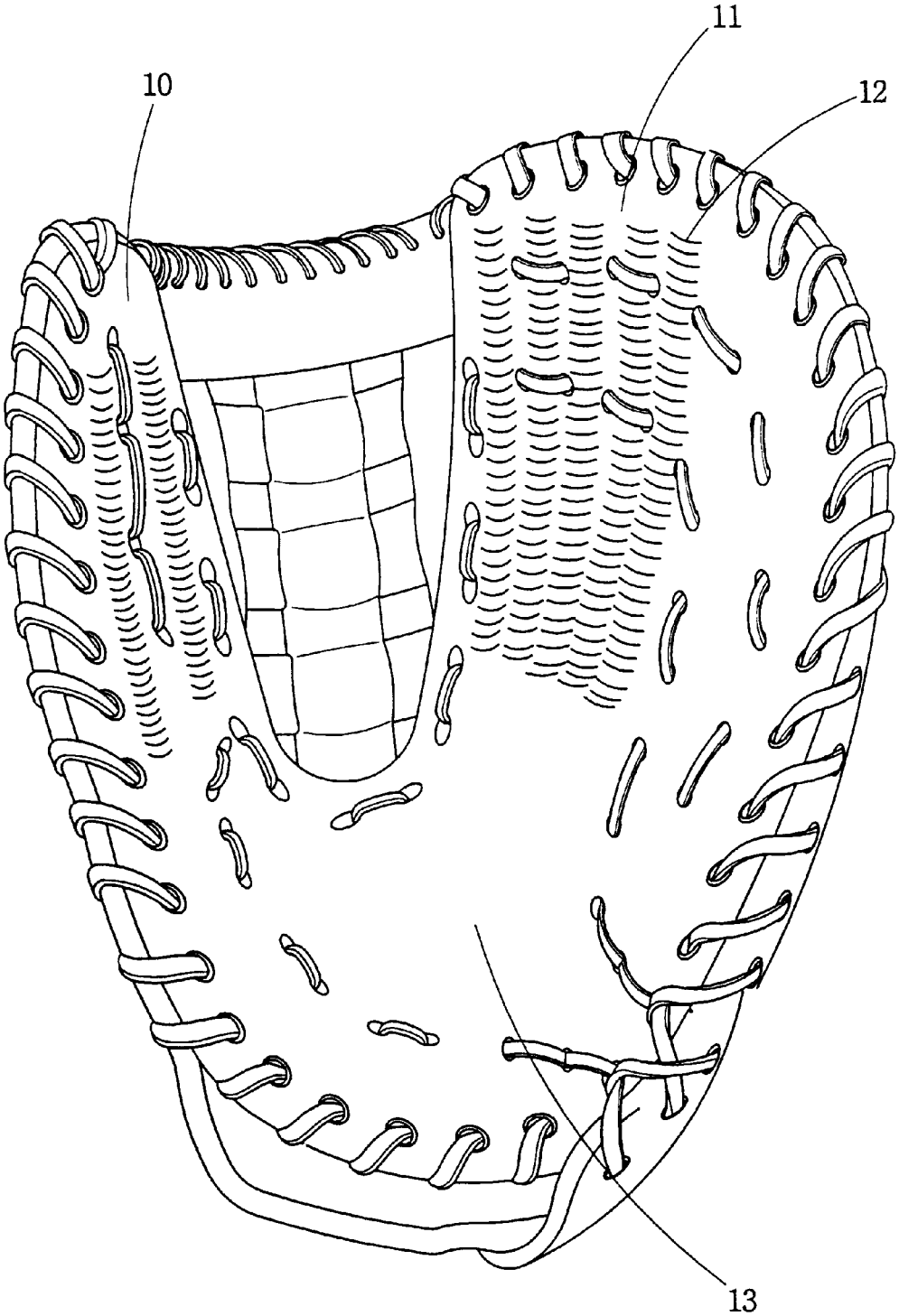
FIG. 5 is a perspective view of a first baseman's glove having a rough skin at its thumb and finger sections in accordance with the second embodiment of the present invention.
Figure 6:
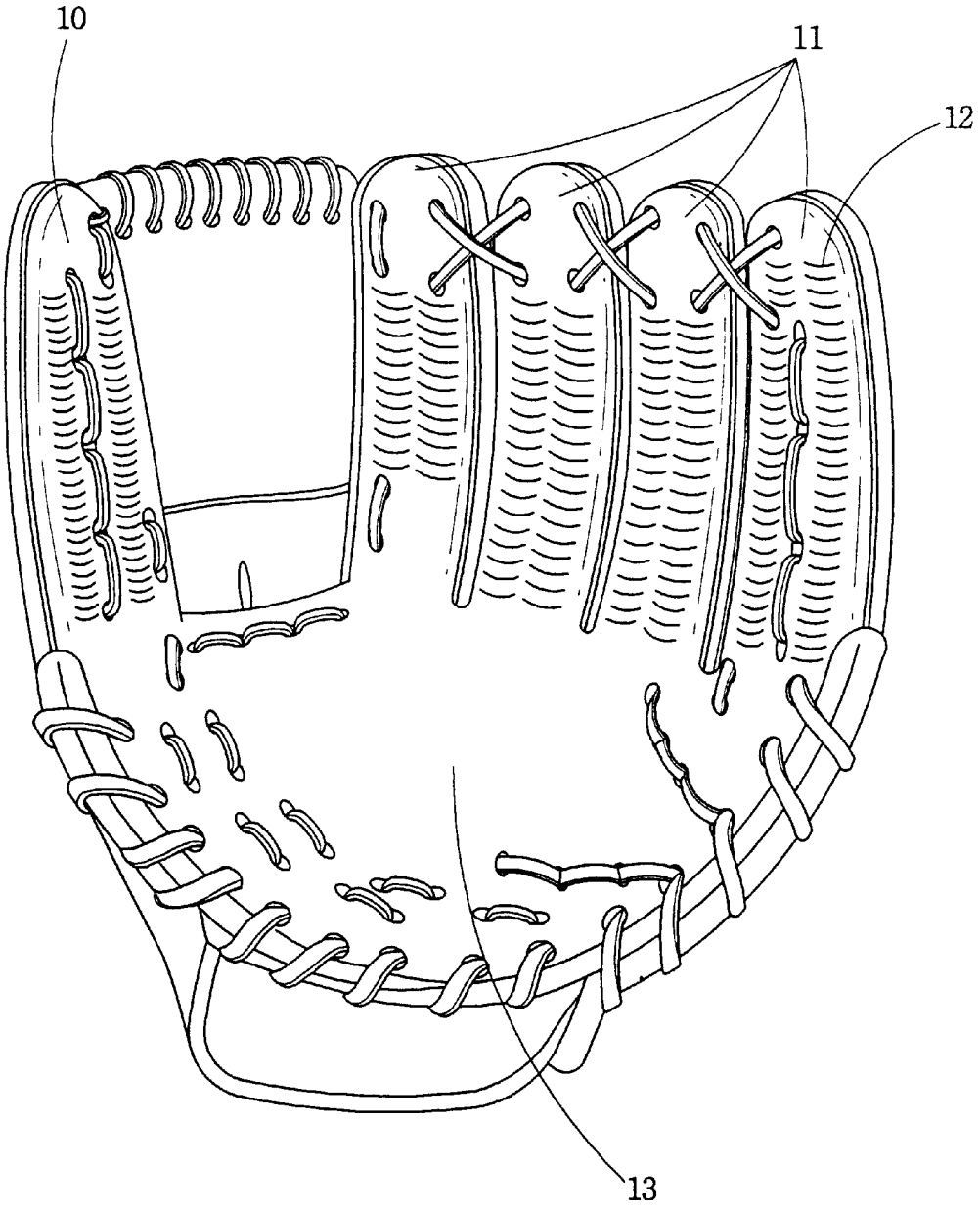
FIG. 6 is a perspective view of a fielder's glove having a rough skin at its thumb and fingers in accordance with the third embodiment of the present invention.
Figure 7:
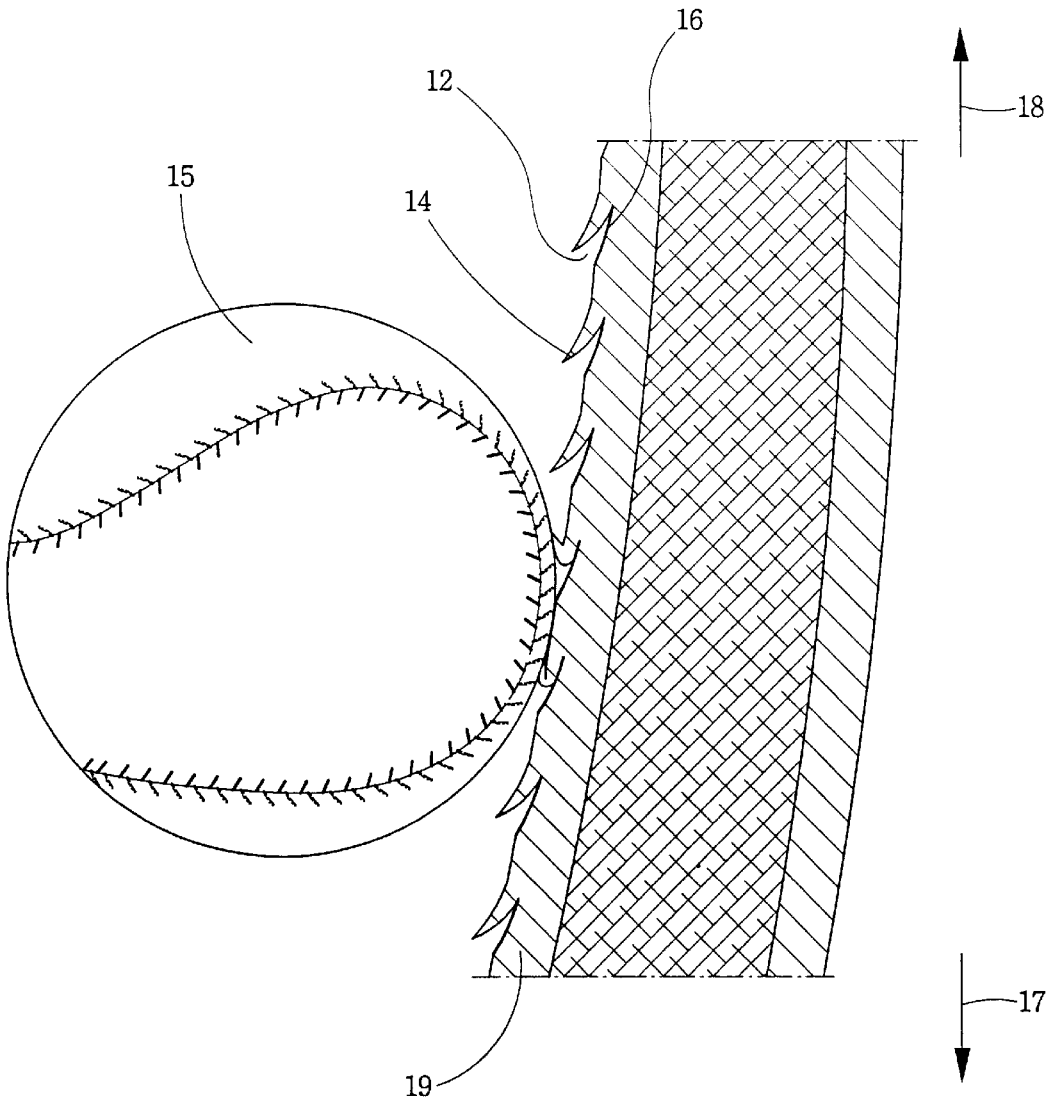
FIG. 7 is a sectional view, showing the ball braking effect of the rough skin formed on the inner surface of a baseball glove according to the present invention.

FIGS. 4, 5 and 6 are perspective views of a catcher's glove, a first baseman's glove and a fielder's glove, each having a rough skin at its thumb and finger sections in accordance with an embodiment of the present invention. FIG. 7 is a sectional view, showing the ball braking effect of the rough skin formed on the inner surface of the glove of this invention.

As shown in the drawings, the baseball glove of this invention is provided with a rough skin on its inner surface except for the palm, web and heel. That is, the rough skin is formed on the inner surface of the thumb section 10 and finger sections 11 of the glove. In order to form the rough skin, the inner surface of those sections 10 and 11 of the glove is regularly, repeatedly and shallowly cut to form several rows of arc-shaped and dense cuts 12, each consisting of a ridge 14 and a groove 16. Each of the arc-shaped and dense cuts 12 is curved toward the palm 13 of the glove.

In the glove of this invention, each of the arc-shaped and dense cuts 12 of the rough skin is not longer than 2 cm. In addition, the intervals between the cuts 12 in each row and the intervals between the rows of cuts 12 are not wider than 1 cm. In the case of a fielder's glove of FIG. 6 used by the infielders and outfielders including a pitcher, it is preferable to set the number of rows of the cuts 12 formed on each of the thumb and fingers to two or less.

In the case of a catcher's glove of FIG. 4 and a first baseman's glove of FIG. 5, it is preferable to set the number of rows of the cuts 12 formed on one section 11 for the four fingers except for the thumb to eight or less. In the baseball gloves of this invention except for the catcher's glove, the rows of cuts 12 are oriented along an axial direction of the thumb and fingers. However, in the case of the catcher's glove of FIG. 4, the rows of cuts 12 formed on the thumb 10 are oriented along a direction perpendicular to the axial direction of the thumb 10, and the number of rows of the cuts 12 formed on the thumb 10 is preferably set to ten or less.

Such a design of the rows of cuts 12 on the thumb 10 of the catcher's glove is necessitated by the fact that the catcher in a game typically catches the pitched ball with the glove while positioning the glove horizontally, different from the other fielders. Therefore, when the rows of cuts 12 formed on the thumb 10 of the catcher's glove are oriented along a direction perpendicular to the axial direction of the thumb 10, the cuts 12 accomplish its desired function as a ball braking means without failure while catching a pitched ball.

The object of the above-mentioned design factors of the cuts 12 is to optimize the operational effect of the cuts 12 as a ball braking means or a ball stopper. That is, when each of the arc-shaped cuts 12 exceeds 2 cm in length or the intervals between the cuts 12 in each row and the intervals between the rows of cuts 12 are wider than 1 cm, the number of the cuts 12 does not reach a desired number. In such a case, the cuts 12 fail to perform their desired operational function.

When the number of rows of the cuts 12, formed on each of the thumb and fingers of the fielder's glove, exceeds two, it is impossible to make the cuts 12 having a desired length, and so the cuts 12 cannot accomplish their operational function as a ball braking means. In the same manner, the number of rows of the cuts 12, formed on one section 11 for the four fingers except for the thumb in the case of the catcher's glove of FIG. 4 or the first baseman's glove of FIG. 5, is set to eight or less, and the number of rows of the cuts 12 formed on the thumb 10 of the catcher's glove is set to ten or less. Of course, it is not necessary to form such cuts 12 on the other portions of the baseball glove except for the inner surface of the thumb and finger sections.

As shown in FIG. 7, the grooves 16 formed by the cuts 12 on the skin 19 of the glove are inclined toward the finger tips, thus forming the ridges 14 on the skin 19 at positions above the grooves 16. These ridges 14 of the cuts 12 are somewhat raised up from the skin 19, thereby forming a unidirectionally cut rough surface on the skin 19 and acting as a ball braking means capable of effectively braking the rotating action of a ball 15 in addition to preventing an unexpected slipping of the ball 15 out of the glove when a user catches the ball 15 with the glove in a game.

The ridges 14 of the cuts 12 formed on the rough skin of the glove form the lugs on the skin, thus increasing the frictional force between the ball 15 and the thumb and finger sections 10 and 11 and thereby remarkably reducing the rotating force of the ball 15 in the glove. In FIG. 7, the reference numeral 17 denotes a direction toward the palm 13, and the numeral 18 denotes a direction toward the finger tip.

As described above, the present invention provides a baseball glove having a rough skin on the inner surface of its thumb and finger sections. In the baseball glove of this invention, the rough skin is formed by regularly, repeatedly and shallowly cutting the inner surface of the thumb and finger sections of the glove to form several rows of arc-shaped and dense cuts, each consisting of a groove and a ridge. The arc-shaped and dense cuts increase the frictional force between the ball and the skin of the glove when catching the ball in a game. The cuts act as a stopper or a braking means capable of braking the rotating action of the ball in addition to reducing the repulsive power created by the force of the ball's impact acting on the skin when catching the ball, thereby preventing an unexpected slipping of the ball out of the glove, and allowing a user in a game to stably catch the ball without failure.

Although a preferred embodiment of the present invention has been described for illustrative purposes, those skilled in the art will appreciate that various modifications, additions and substitutions are possible, without departing from the scope and spirit of the invention as disclosed in the accompanying claims.

What is claimed is:

1. A baseball glove, comprising:

a plurality of rows of arc-shaped cuts formed on an inner surface of thumb and finger sections of the glove by regularly, repeatedly and shallowly cutting the inner surface of said thumb and finger sections to form grooves and ridges, said rows of cuts being oriented along a direction perpendicular to an axial direction of the thumb and finger sections, said grooves of the cuts being inclined toward the finger tips of the glove, thus allowing each of the ridges to have an arc shape curved toward a palm of the glove and to be raised up from a skin of the glove so as to brake a rotating action of a ball in addition to preventing an expected slipping of the ball out of the glove when catching the ball, and wherein each of said arc-shaped cuts is not longer than 2 cm, with intervals between the cuts in each row and intervals between the rows of cuts being not wider than 1 cm.

* * * * *